US012628912B2

(12) United States Patent
Suzuki et al.

(10) Patent No.: US 12,628,912 B2
(45) Date of Patent: May 19, 2026

(54) SHOES

(71) Applicant: ASICS CORPORATION, Kobe (JP)

(72) Inventors: Chihaya Suzuki, Hyogo (JP); Shingo Masumoto, Hyogo (JP); Keita Ozawa, Hyogo (JP); Hiroki Nakamura, Hyogo (JP); Keishi Kitamoto, Hyogo (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/872,685

(22) PCT Filed: Jun. 10, 2022

(86) PCT No.: PCT/JP2022/023468
§ 371 (c)(1),
(2) Date: Dec. 6, 2024

(87) PCT Pub. No.: WO2023/238389
PCT Pub. Date: Dec. 14, 2023

(65) Prior Publication Data

US 2025/0359631 A1 Nov. 27, 2025

(51) Int. Cl.
*A43B 23/02* (2006.01)
*A43B 7/08* (2022.01)

(52) U.S. Cl.
CPC ..... *A43B 23/027* (2013.01); *A43B 7/08* (2013.01)

(58) Field of Classification Search
CPC ..... A43B 23/027; A43B 7/08
USPC ..... 36/83
See application file for complete search history.

(56) References Cited

U.S. PATENT DOCUMENTS

| | | | | |
|---|---|---|---|---|
| 3,184,930 | A | 5/1965 | Breitinger | |
| 9,078,488 | B1 * | 7/2015 | Meir | D04B 1/22 |
| 2004/0134099 | A1 | 7/2004 | Jones et al. | |
| 2015/0059209 | A1 | 3/2015 | Dekovic et al. | |
| 2018/0317594 | A1 | 11/2018 | Brinkman et al. | |
| 2019/0223540 | A1 | 7/2019 | Cox et al. | |
| 2019/0365049 | A1 * | 12/2019 | Verfl | A43B 23/0275 |
| 2020/0397091 | A1 | 12/2020 | Cox et al. | |
| 2021/0153595 | A1 * | 5/2021 | Schoppel | A43B 1/04 |

FOREIGN PATENT DOCUMENTS

| | | | |
|---|---|---|---|
| JP | 2004-174251 | A | 6/2004 |
| WO | 2018/204650 | A1 | 11/2018 |
| WO | 2019/143480 | A1 | 7/2019 |

OTHER PUBLICATIONS

The extended European search report issued by the European Patent Office on Jun. 4, 2025, which corresponds to European Patent Application No. 22945888.0-1015 and is related to U.S. Appl. No. 18/872,685.
International Search Report issued in PCT/JP2022/023468; mailed Jul. 19, 2022.
Communication pursuant to Article 94(3) EPC issued by the European Patent Office on Mar. 18, 2026, which corresponds to European Patent Application No. 22945888.0-1015 and is related to U.S. Appl. No. 18/872,685.

* cited by examiner

*Primary Examiner* — Timothy K Trieu
(74) *Attorney, Agent, or Firm* — Studebaker Brackett PLLC

(57) ABSTRACT

A shoe includes an upper that covers the instep of a foot. A hole that has a bottom and is recessed in the thickness direction of the upper is integrally formed in the upper. A bottom portion of the hole is one layer including at least two linear members that differ in stretchability.

9 Claims, 3 Drawing Sheets

SHOES

FIELD

The present disclosure relates to a shoe including an upper.

BACKGROUND

When shoes are worn for a long time, or when shoes are worn for exercise such as running, the temperature and the humidity of the inside of the shoes rise. When the temperature and the humidity of the inside of shoes rise, the inside of the shoes becomes stuffy, and the comfort of the wearer is impaired.

Therefore, air permeability inside shoes is normally enhanced by providing through holes in the uppers (see Patent Literature 1, for example).

CITATION LIST

Patent Literature

Patent Literature 1: JP 2004-174251 A

SUMMARY

Technical Problem

However, when through holes are disposed in the uppers, the rigidity of the portions of the uppers at which the through holes are disposed drops. This causes the following problem: when the wearer of the shoes performs exercise such as running, the uppers excessively expand and contract around the portions at which the through holes are disposed. Therefore, there is a demand for development of shoes that are capable of preventing excessive expansion and contraction of the uppers while ensuring air permeability inside the shoes.

The present disclosure has been made in view of the above, and aims to obtain shoes that are capable of preventing excessive expansion and contraction of the uppers while ensuring air permeability inside the shoes.

Solution to Problem

In order to solve the above problem and achieve the object, a shoe comprising an upper that covers an instep of a foot, wherein a hole that has a bottom and is recessed in a thickness direction of the upper is formed integrally in the upper, and a bottom portion of the hole is a single layer including at least two linear members that differ in stretchability.

Advantageous Effects of Invention

A shoe according to the present disclosure has an effect of preventing excessive expansion and contraction of the upper while ensuring air permeability inside the shoe.

DESCRIPTION OF EMBODIMENTS

Figure 1:
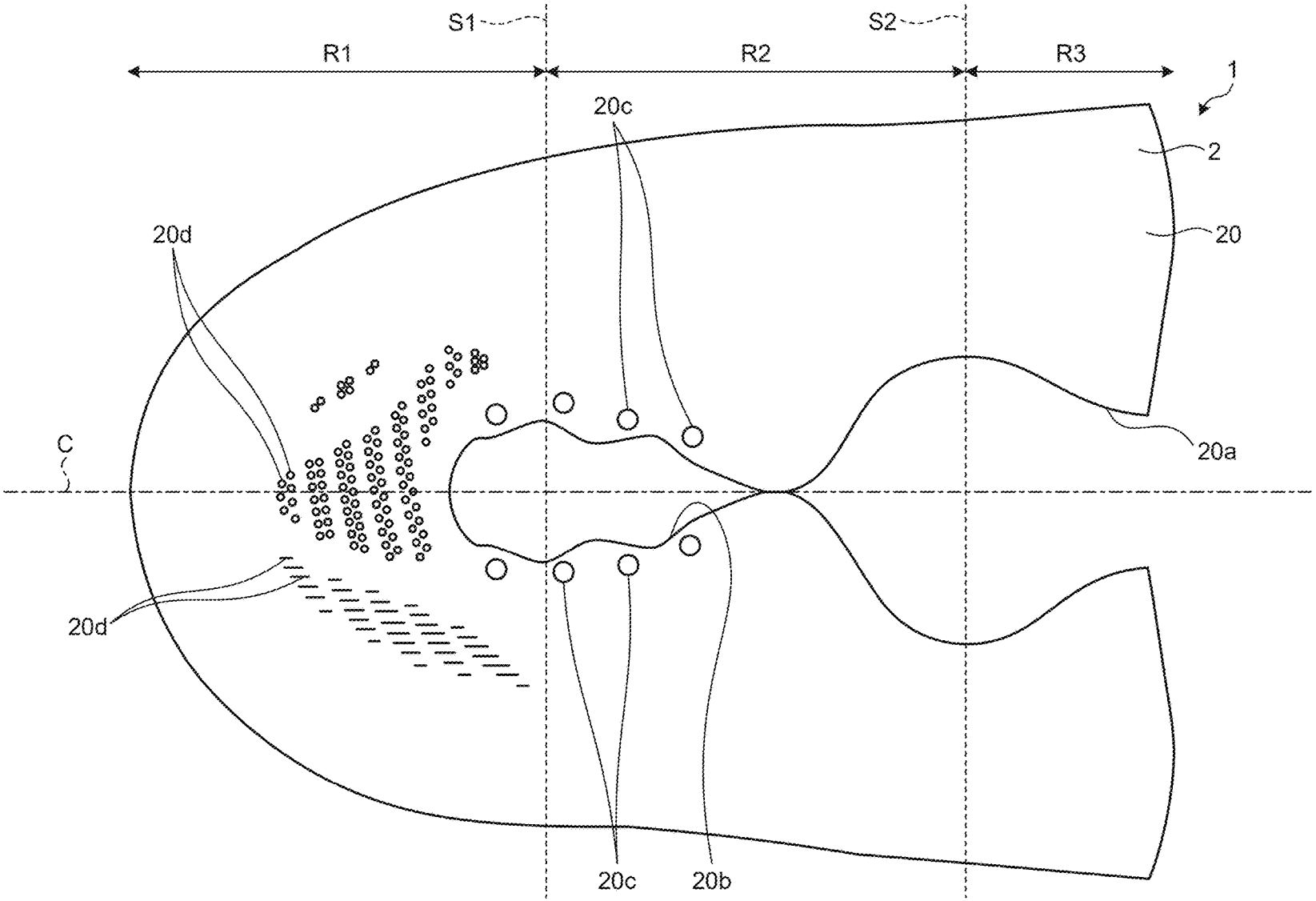
FIG. 1 is a developed view illustrating the upper of a shoe according to a first embodiment of the present disclosure.

The following is a detailed description of an embodiment of a shoe according to the present disclosure, with reference to the drawings. Note that the present disclosure is not limited by this embodiments. In the description below, the same portions are denoted by the same reference numerals, and explanation of them will be repeated.

First Embodiment

FIG. 1 is a developed view illustrating the upper 2 of a shoe 1 according to a first embodiment of the present disclosure. In the drawings including FIG. 1, only a shoe 1 for the left foot is illustrated. Since the shoe 1 for the left foot has a structure symmetrical with the shoe for the right foot, only the shoe 1 for the left foot is described in the present embodiment, and explanation of the shoe 1 for the right foot is not made herein. In the description below, a direction in which a shoe center axis C, which is a perpendicular line passing through the center of the shoe 1 in a planar view of the shoe 1, extends will be referred to as the longitudinal direction, and a direction orthogonal to the longitudinal direction in a planar view of the shoe 1 will be referred to as the foot width direction.

In the description below, of the longitudinal direction, the direction from the heel toward the toe of the shoe 1 will be referred to as the fore direction, and the direction from the toe toward the heel of the shoe 1 will be referred to as the rear direction.

In the description below, the median side in the anatomical normal position of the foot will be referred to as the medial foot side, and the side opposite to the median side in the anatomical normal position of the foot will be referred to as the lateral foot side. That is, the side closer to the median line in the anatomical normal position will be referred to as the medial foot side, and the side farther from the median line in the anatomical normal position will be referred to as the lateral foot side.

In the description below, the vertical direction means the direction orthogonal to both the longitudinal direction and the foot width direction, unless otherwise specified.

The upper 2 includes an upper fore foot position R1 covering the fore foot position of a foot of a wearer having a standard body shape, an upper middle foot position R2 covering the middle foot position of the foot of the wearer having a standard body shape, and an upper rear foot position R3 covering the rear foot position of the foot of the wearer having a standard body shape. The upper fore foot position R1, the upper middle foot position R2, and the upper rear foot position R3 are successively present in this order in the direction from the fore to the rear of the upper 2.

The line that extends in the foot width direction and passes through a position corresponding to about 35% to 45% of the dimension of the upper 2 in the longitudinal direction of the upper 2 from the fore end is defined as a first boundary line S1, and the line that extends the foot width direction and passes through a position corresponding to about 75% to 85% of the dimension of the upper 2 in the longitudinal direction from the fore end of the upper 2 is defined as a second boundary line S2. The first boundary line S1 is a line that extends substantially along the MP joint of the wearer having a standard body shape. The second boundary line S2 is a line that extends substantially along the Chopart's joint of the wearer having a standard body shape. The upper fore foot position R1 is a portion located on the fore side of the first boundary line S1. The upper middle foot position R2 is a portion located between the first boundary line S1 and the second boundary line S2. The upper rear foot position R3 is a portion located on the rear side of the second boundary line S2.

Figure 2:
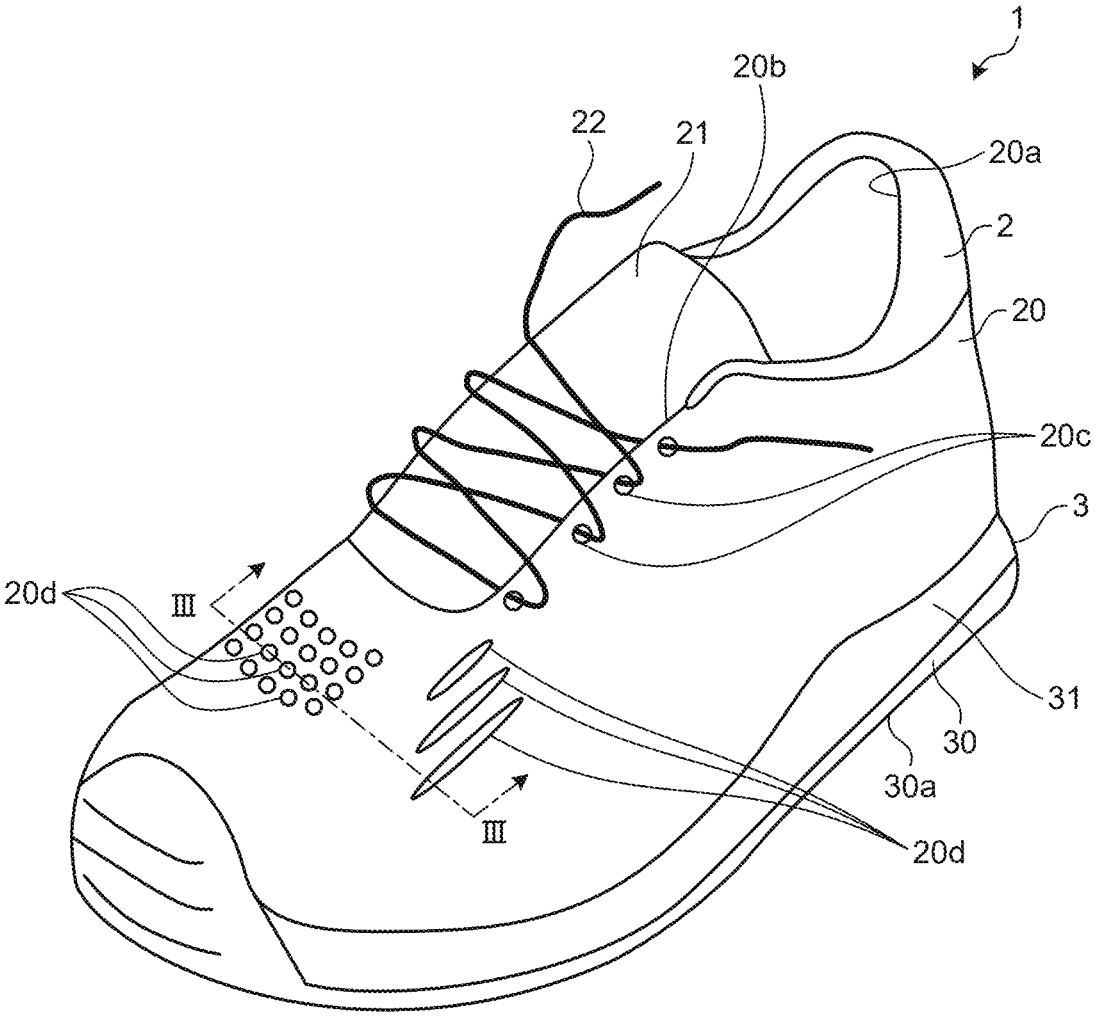
FIG. 2 is a perspective view illustrating the shoe according to the first embodiment of the present disclosure.

FIG. 2 is a perspective view illustrating the shoe 1 according to the first embodiment of the present disclosure. The shoe 1 is preferably a shoe for running, but may be a shoe for other sports, such as a shoe for walking or a shoe for climbing. The shoe 1 includes the upper 2 and a sole 3.

The upper 2 is located above the sole 3. The upper 2 includes an upper main body 20, a shoe tongue 21, and a shoelace 22.

The upper main body 20 covers a portion on the instep side of the foot of the wearer. A foot insertion opening 20*a*, a throat portion 20*b*, and a plurality of holes 20*d* are disposed in the upper portion of the upper main body 20. The foot insertion opening 20*a* is an opening for allowing the foot of the wearer to enter the inside of the upper main body 20. The throat portion 20*b* is an opening that communicates with the foot insertion opening 20*a* and extends in the fore direction from the foot insertion opening 20*a*. A plurality of lace hole portions 20*c* separated from one another in the longitudinal direction is disposed on both side edges of the throat portion 20*b* in the foot width direction. In FIG. 2, only the lace hole portions 20*c* disposed at the side edge on the lateral foot side of the throat portion 20*b* are illustrated. The lace hole portions 20*c* only needs to enable the shoelace 22 to pass therethrough. The lace hole portions 20*c* are through holes that penetrate the upper main body 20 in the thickness direction of the upper main body 20, for example. The number of the holes 20*d* may be increased or decreased as appropriate, and FIGS. 1 and 2 illustrate cases where the numbers of the holes 20*d* are different from each other. The upper main body 20 including the holes 20*d* will be described later in detail.

The shoe tongue 21 is a member for protecting the instep of the foot of the wearer. The shoe tongue 21 covers the throat portion 20*b* inside the upper main body 20. The shoe tongue 21 is secured to the upper main body 20 by stitching, welding, bonding, or a combination thereof. The upper main body 20 and the shoe tongue 21 are knitted fabric in which yarns are rolled into a chain-like shape and chain-like portions are hooked to one another to form a cloth, woven fabric in which warp yarns and weft yarns cross each other at a certain angle to form a cloth, and a set in which three or more braid yarns cross one another and run obliquely to form a cloth, for example. In particular, in the shoe 1 in which air permeability and lightweight properties are required, the upper main body 20 and the shoe tongue 21 are preferably double raschel warp knitted fabric knitted with polyester yarns. Note that the materials of the upper main body 20 and the shoe tongue 21 are not limited to the materials mentioned as examples.

The shoelace 22 is a string-like member that passes alternately through the lace hole portions 20*c* disposed at one side edge in the foot width direction of the throat portion 20*b* and the lace hole portions 20*c* disposed at the other side edge in the foot width direction. The shoelace 22 is detachably attached to the upper main body 20.

Note that, in the present embodiment, the upper 2 including the shoe tongue 21 and the shoelace 22 is described as an example, but the upper 2 may have a monosock structure in which the portion corresponding to the shoe tongue 21 is integrated with the ankle portion of the upper main body 20. Also, the means for bringing the upper main body 20 into close contact with the foot may be a hook-and-loop fastener, for example, instead of the shoelace 22. In a case where the means for bringing the upper main body 20 into close contact with the foot is a hook-and-loop fastener, the lace hole portions 20*c* are not disposed in the upper main body 20.

The sole 3 is located below the upper 2. The sole 3 covers the sole of the wearer. The sole 3 is secured to the upper main body 20 by stitching, welding, bonding, or a combination thereof. The sole 3 includes an outsole 30 and a midsole 31. The lower face of the outsole 30 serves as a ground contact face 30*a* to be in contact with the ground. The midsole 31 is located on the upper face of the outsole 30, and has cushioning properties. Note that the outsole 30 may be integrated with the midsole 31. The outsole 30 integrated with the midsole 31 is also referred to as the "unisole".

Although not illustrated, the sole 3 includes an inner sole that covers the lower opening of the upper main body 20. The inner sole is secured to the upper face of the midsole 31 by adhesion or welding. The inner sole is secured to the lower edge of the upper main body 20 by stitching. Although not illustrated, the shoe 1 may include an insole. When the shoe 1 includes an insole, the insole is placed on the sole 3 inside the upper 2. Note that the sole 3 may have a structure that excludes the inner sole.

Next, the upper main body 20 will be described in detail.

Figure 3:
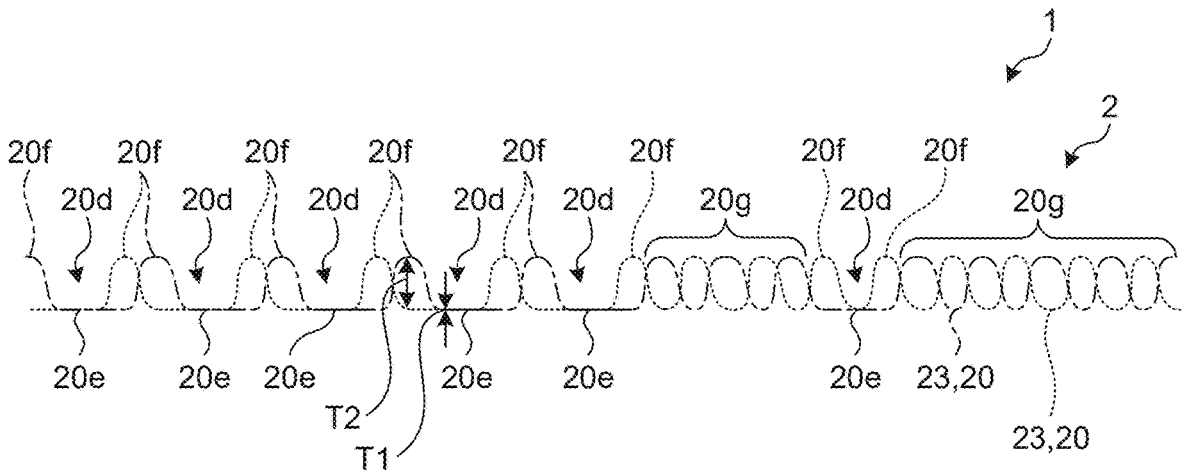
FIG. 3 is a cross-sectional view taken along the line III-III illustrated in FIG. 2.

As illustrated in FIG. 1, the upper main body 20 includes the upper fore foot position R1, the upper middle foot position R2, and the upper rear foot position R3. FIG. 3 is a cross-sectional view taken along the line III-III illustrated in FIG. 2. As illustrated in FIG. 3, the upper main body 20 includes a plurality of linear members 23 disposed independently of one another. Although two linear members 23 are illustrated in FIG. 3, other linear members 23 are also present in the depth direction of the drawing. In FIG. 3, to distinguish the two linear members 23 from each other, one linear member 23 is indicated by a dot-and-dash line, and the other linear member 23 is indicated by a dashed line. The linear members 23 are disposed over the entire regions of the upper fore foot position R1, the upper middle foot position R2, and the upper rear foot position R3.

A linear member 23 is a yarn obtained by bundling a plurality of fibers, a linear resin, a twisted yarn, or the like, for example. The material of the linear members 23 is polyester, polyurethane-based thermoplastic elastomer, polyurethane, nylon, spandex, Kevlar (registered trademark), ultra-high molecular weight polyethylene, single covered Yarn (SCY) or double covered Yarn (DCY) covered with polyurethane, or the like, for example. Each linear member 23 has portions alternately protruding in one direction and the other direction in the thickness direction of the upper 2. The melting point of the material of each linear member 23 is preferably 150° C. or higher, and the difference in melting point between the materials of the respective linear members 23 is preferably 30° C. or lower.

A bottom portion 20*e*, a peripheral portion 20*f*, and a base portion 20*g* are disposed in the upper main body 20. The bottom portion 20*e* is a portion where the respective linear members 23 overlap each other in the thickness direction of the upper main body 20, to form one layer. In a case where the bottom portion 20*e* is viewed from the direction perpendicular to the thickness direction of the upper main body 20 and the direction perpendicular to the length direction of the linear members 23, the respective linear members 23 overlap each other at the bottom portion 20*e*. Although not illustrated, in a case where the bottom portion 20*e* is viewed in the thickness direction of the upper main body 20, the linear members 23 overlap each other so as to form stitches at the bottom portion 20*e*.

The peripheral portion 20*f* is a two-layer portion that is disposed around the bottom portion 20*e*. In the peripheral portion 20*f*, part of the linear members 23 forms one layer, and the remaining part of the linear members 23 forms the other layer. One layer and the other layer of the peripheral portion 20*f* are separated from each other in the thickness direction of the upper main body 20. A thickness T1 of the bottom portion 20*e* is smaller than a thickness T2 of the peripheral portion 20*f*. The thickness T1 of the bottom portion 20*e* with respect to the thickness T2 of the peripheral portion 20*f* may be changed as appropriate, but is preferably 5% to 65%, more preferably 10% to 60%, or even more preferably 20% to 55%.

The base portion 20*g* is adjacent to the peripheral portion 20*f*. The base portion 20*g* includes a two-layer portion in which part of the plurality of linear members 23 forms one layer while the rest of the plurality of linear members 23 forms the other layer, and a portion in which the linear members 23 intersect with each other. One layer and the other layer of the base portion 20*g* are separated from each other in the thickness direction of the upper main body 20. In a case where the base portion 20*g* is viewed from the direction perpendicular to the thickness direction of the upper main body 20 and the direction perpendicular to the length direction of the linear members 23, the linear members 23 intersect with each other at part of the base portion 20*g*. Although not illustrated, in a case where the base portion 20*g* is viewed in the thickness direction of the upper main body 20, the linear members 23 may or may not intersect with each other at the base portion 20*g*.

The holes 20*d* that have bottoms and are recessed in the thickness direction of the upper main body 20 are integrally formed in the upper main body 20. A plurality of holes 20*d* is disposed in the upper main body 20. The holes 20*d* are so-called fake holes that do not penetrate the upper main body 20. The holes 20*d* are open toward the outside of the upper main body 20. In other words, the holes 20*d* are open toward the side opposite to the foot of the wearer. The inner wall of a hole 20*d* includes the bottom portion 20*e* and the peripheral portion 20*f*. That is, the hole 20*d* is a space surrounded by the bottom portion 20*e* and the peripheral portion 20*f*. The holes 20*d* are not disposed in the base portion 20*g*. The air permeability of the portion of the upper 2 in which the holes 20*d* are disposed is higher than the air permeability of the portion of the upper 2 in which the base portion 20*g* is disposed.

The bottom portion 20*e* of the holes 20*d* is one layer formed with at least two linear members 23 that differ in stretchability. FIG. 3 illustrates a case where the bottom portion 20*e* of the holes 20*d* is formed with two linear members 23 that differ in stretchability. In the example illustrated in the drawing, the stretchability of the linear member 23 indicated by a dot-and-dash line is lower than the stretchability of the linear member 23 indicated by a dashed line. The stretchability of a linear member 23 varies depending on the thickness, the material, and the processed state of the linear member 23. To cause the at least two linear members 23 constituting the bottom portion 20*e* to differ in stretchability, at least one of the thickness, the material, and the processed state of each linear member 23 is changed. In particular, a crimped yarn and a non-crimped yarn that are the same in material and molecular structure but differ in stretchability depending on the processed states of the yarns are preferably used for a combination of the linear members 23 that differ in stretchability. The stretchability of each linear member 23 can be evaluated on the basis of the Young's modulus of each linear member 23. The difference in Young's modulus between the at least two linear members 23 constituting the bottom portion 20*e* is preferably 5% or larger. The proportion of the linear member 23 having the higher stretchability to the entire upper main body 20 is preferably higher than the proportion of the linear member 23 having the lower stretchability to the entire upper main body 20. The proportion of the linear member 23 having the low stretchability to the bottom portion 20*e* of the holes 20*d* is preferably higher than the proportion of the linear member 23 having the higher stretchability to the bottom portion 20*e* of the holes 20*d*.

The plurality of linear members 23 constituting the bottom portion 20*e* of the holes 20*d* may be entangled or may not be entangled. In the present specification, the plurality of linear members 23 being entangled means the linear members 23 being interwoven, the linear members 23 being woven into each other, the linear members 23 being incorporated into each other, or the like. In the present specification, the plurality of linear members 23 not being entangled means that the linear members overlap each other by their own weights and constitute one layer. In the present embodiment, the peripheral portion 20*f* and the base portion 20*g* are also formed with at least two linear members 23 that differ in stretchability.

As illustrated in FIG. 1, the plurality of holes 20*d* is disposed in the upper fore foot position R1 in the present embodiment. However, the plurality of holes 20*d* is only required to be disposed in at least one of the upper fore foot position R1, the upper middle foot position R2, and the upper rear foot position R3. The holes 20*d* are disposed on the fore side of the throat portion 20*b* and on an obliquely fore side of the throat portion 20*b*, with some exceptions. The holes 20*d* are disposed in the central portion, the medial foot side portion, and the lateral foot side portion of the upper fore foot position R1. The holes 20*d* disposed in the central portion and the medial foot side portion of the upper fore foot position R1 have a circular shape in a planar view. The circular holes 20*d* are arranged side by side in the longitudinal direction and the foot width direction. The holes 20*d* disposed in the lateral foot side portion of the upper fore foot position R1 are elongate holes extending in the longitudinal direction. The elongate holes 20*d* are arranged side by side in the longitudinal direction and the foot width direction.

Next, the effects of the shoe 1 according to the present embodiment are described.

In the present embodiment, as illustrated in FIG. 3, the holes 20*d* that have bottoms and are recessed in the thickness direction of the upper 2 are formed integrally in the upper 2, so that the air permeability of the inside of the shoe 1 can be enhanced. Also, in the present embodiment, the bottom portion 20*e* of the holes 20*d* is one layer formed with at least two linear members 23 that differ in stretchability. Thus, the stretchability of the bottom portion 20*e* of the holes 20*d* can be adjusted. For example, part of the bottom portion 20*e* of the holes 20*d* is formed with a linear member 23 having a low stretchability.

In this manner, excessive expansion and contraction of the upper 2 around the portion in which the holes 20*d* are disposed can be prevented when the wearer of the shoe 1 performs exercise such as running. That is, in the present embodiment, it is possible to prevent excessive expansion and contraction of the upper 2, while ensuring air permeability of the inside of the shoe 1.

In the present embodiment, as illustrated in FIG. 3, the holes 20*d* have bottoms. Thus, foreign matter such as dust and sand can be prevented from entering the inside of the shoe 1 through the holes 20*d*.

In the present embodiment, as illustrated in FIG. 3, the bottom portion 20*e* in which the respective linear members 23 overlap each other in the thickness direction to form one layer is disposed in the upper 2. Also, in the upper 2, the two-layer peripheral portion 20*f* is disposed around the bottom portion 20*e*. In the peripheral portion 20*f*, part of the linear members 23 forms one layer, and the remaining part of the linear members 23 forms the other layer. Further, the base portion 20*g* that includes a two-layer portion in which part of the plurality of linear members 23 forms one layer while the rest of the plurality of linear members 23 forms the other layer, and a portion in which the linear members 23 intersect with each other is disposed in the upper 2. With these components, the bottom portion 20*e*, the peripheral portion 20*f*, and the base portion 20*g* are continuously and integrally disposed by virtue of the plurality of linear members 23, and the holes 20*d* are disposed integrally in the upper 2. Although not illustrated, in a case where through holes are disposed in the upper 2, and a base cloth is bonded to the upper 2 so as to close the opening on one side of each through hole and form holes each having a bottom in the upper 2, the problem of detachment of the base cloth occurs. In this regard, the holes 20*d* are formed integrally in the upper 2 in the present embodiment, and therefore, the above problem does not occur.

In the process of molding the material of each linear member 23 illustrated in FIG. 3, the material is heated to around 150° C. in some cases. In such a case, if the melting point of the material of each linear member 23 is 150° C. or higher as in the present embodiment, it is possible to prevent the material of each linear member 23 from being melted and resinified. In the shoe manufacturing process, there is a step of heating the shaped shoe 1. In the step of heating the shoe 1, to prevent the resinization accompanying melting of the linear members 23, the temperature to which the shoe 1 is to be heated is generally set so that a linear member 23 formed with a low-melting-point material does not melt. In a case where the difference in melting point between the materials of the respective linear members 23 is large (for example, in a case where the difference in melting point between the materials of the respective linear members 23 exceeds 30° C.), there is a possibility that the standard shape or the like of a linear member 23 formed with a high-melting-point material will be adversely affected. Therefore, if the difference in melting point between the materials of the respective linear members 23 is 30° C. or less as in the present embodiment, the standard shape or the like of a linear member 23 formed with a high-melting-point material is not adversely affected even in a case where the temperature to which the shoe 1 is to be heated is set so that a linear member 23 formed with a low-melting-point material does not melt.

In the present embodiment, as illustrated in FIG. 3, the upper 2 includes the holes 20*d* and the base portion 20*g*, and the air permeability of the portion of the upper 2 in which the holes 20*d* are disposed is higher than the air permeability of the portion of the upper 2 in which the base portion 20*g* is disposed. Accordingly, in the present embodiment, the air permeability of the inside of the shoe 1 can be made higher than that of an upper including only the base portion 20*g*. Note that the inventor of the present disclosure conducted an experiment for measuring the air permeability of the portion of the upper 2 in which both the holes 20*d* and the base portion 20*g* were disposed, and the air permeability of the portion of the upper 2 in which only the base portion 20*g* was disposed, in accordance with JIS L1096 A method (Frazir type method). In the portion of the upper 2 in which both the holes 20*d* and the base portion 20*g* were disposed, the ratio between the holes 20*d* and the base portion 20*g* was approximately 1:3. As a result of the experiment, the air permeability of the portion of the upper 2 in which both the holes 20*d* and the base portion 20*g* were disposed was 46.2 $cm^3/cm^2 \cdot s$, and the air permeability of the portion of the upper 2 in which only the base portion 20*g* was disposed was 42.8 $cm^3/cm^2 \cdot s$. The result of this experiment proved that the holes 20*d* each having a bottom are effective in enhancing the air permeability of the inside of the shoe 1.

In the present embodiment, as illustrated in FIG. 1, the holes 20*d* are disposed in the upper fore foot position R1. Thus, the air permeability of the inside of the shoe 1 can be enhanced, and the upper fore foot position R1 is easily deformed following movement of the foot.

When the wearer of the shoe 1 performs exercise such as running, the fore foot portion of the foot is twisted in the direction from the lateral foot side toward the medial foot side, and the lateral foot side portion of the upper fore foot position R1 illustrated in FIG. 1 is sheared and deformed. In the present embodiment, the holes 20*d* disposed in the lateral foot side portion of the upper fore foot position R1 are elongate holes extending in the longitudinal direction, and accordingly, the lateral foot side portion of the upper fore foot position R1 is easily sheared and deformed, following movement of the foot. Thus, contact of the foot with the upper 2 can be alleviated, and the occurrence of wrinkles in the upper 2 can be suppressed.

In the present embodiment, as illustrated in FIG. 3, the holes 20*d* are open toward the side opposite to the foot of the wearer. Accordingly, unevenness on the inner surface side of the upper 2 can be reduced, and thus, contact of the foot with the upper 2 can be alleviated.

Note that, although the number of linear members 23 constituting the bottom portion 20*e*, the peripheral portion 20*f*, and the base portion 20*g* illustrated in FIG. 3 is two in the present embodiment, the number may be three or larger. If the number of the linear members 23 is three or larger, the stretchability of the upper main body 20 can be adjusted in a larger number of multiple stages. In a case where the number of the linear members 23 is three or larger, the stretchability of each linear member 23 may be set as appropriate, depending on the purpose of use of the shoe 1 or the like. For example, the stretchability of each linear member 23 may be different, or the stretchability of at least one linear member 23 may be different from the stretchability of the other linear members 23. In a case where the number of the linear members 23 is three or larger, the number of the linear members 23 to be one layer and the number of the linear members 23 to be the other layer in the peripheral portion 20*f* and the base portion 20*g* may be set as appropriate, depending on the purpose of use of the shoe 1 or the like.

Although two or more linear members 23 that differ in stretchability are used for the bottom portion 20*e*, the peripheral portion 20*f*, and the base portion 20*g* in the present embodiment, the two or more linear members 23 are only required to be used at least for the bottom portion 20*e*.

Figure 4:
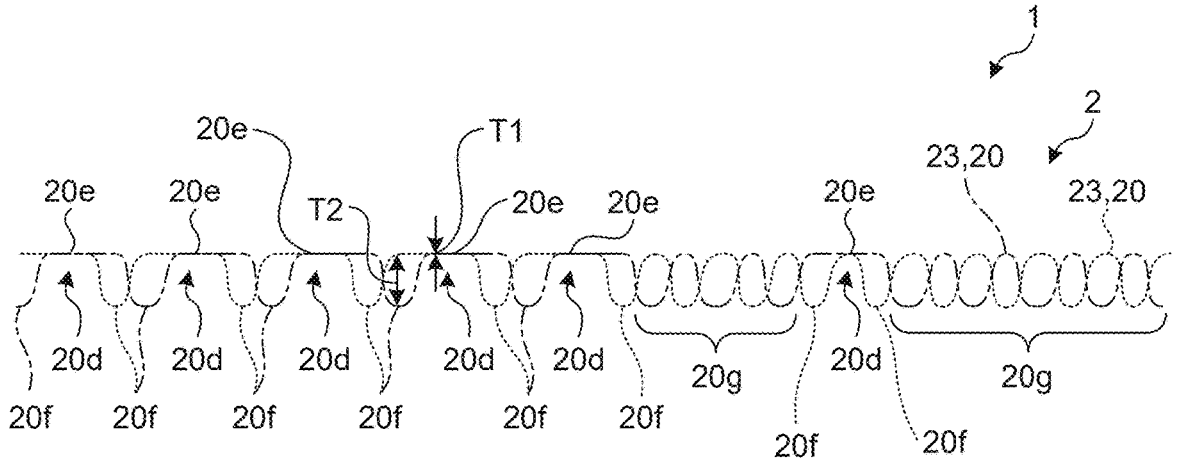
FIG. 4 is a cross-sectional view illustrating an upper of a shoe according to a modification of the first embodiment of the present disclosure, and is a view corresponding to a cross-sectional view taken along the line III-III illustrated in FIG. 2.

FIG. 4 is a cross-sectional view illustrating the upper 2 of a shoe 1 according to a modification of the first embodiment of the present disclosure, and is a view corresponding to a cross-sectional view taken along the line III-III illustrated in FIG. 2. As illustrated in FIG. 4, the holes 20*d* may open toward the inside of the upper main body 20. In other words, the holes 20*d* are open toward the foot of the wearer. With this arrangement, the opening of each hole 20*d* does not face the outside of the upper main body 20. Thus, foreign matter such as dust and sand is less likely to enter the insides of the holes 20*d*.

The configuration described in the above embodiment is merely an example of the content of the present disclosure, and can be combined with another known technique. Also, part of the configuration can be omitted or modified, without departing from the scope of the present disclosure.

A shoe according to a first aspect includes an upper that covers the instep of a foot, in which a hole that has a bottom and is recessed in the thickness direction of the upper is formed integrally in the upper, and the bottom portion of the hole is a single layer formed with at least two linear members that differ in stretchability.

A shoe according to a second aspect is the shoe according to the first aspect, in which each of the linear members has portions alternately protruding in one direction and the other direction in the thickness direction, and the upper includes: the bottom portion in which the linear members overlap each other in the thickness direction, to form one layer;

a peripheral portion that is disposed around the bottom portion, and has two layers, part of the linear members being one of the two layers, the remaining part of the linear members being the other one of the two layers; and a base portion including: a two-layer portion in which part of the linear members is one layer, and the remaining part of the linear members is the other layer; and a portion in which the linear members intersect with each other.

A shoe according to a third aspect is the shoe according to the second aspect, in which the melting point of the material of each of the linear members is 150° C. or higher, and the difference in melting point between the materials of the respective linear members is 30° C. or less.

A shoe according to a fourth aspect is the shoe according to the second or third aspect, in which the ratio of the thickness of the bottom portion to the thickness of the peripheral portion is 5% to 65%.

A shoe according to a fifth aspect is the shoe according to any one of the second to fourth aspects, in which the air permeability of the portion of the upper in which the hole is disposed is higher than the air permeability of the portion of the upper in which the base portion is disposed.

A shoe according to a sixth aspect is the shoe according to any one of the first to fifth aspects, in which the upper includes an upper fore foot position covering the fore foot position of the foot of the wearer, an upper middle foot position covering the middle foot position of the foot of the wearer, and an upper rear foot position covering the rear foot position of the foot of the wearer, and the hole is disposed in the upper fore foot position.

A shoe according to a seventh aspect is the shoe according to the sixth aspect, in which the hole disposed in a lateral foot side portion of the upper fore foot position is an elongate hole extending in a longitudinal direction.

A shoe according to an eighth aspect is the shoe according to any one of the first to seventh aspects, in which the hole is open toward the side opposite to the foot of the wearer.

A shoe according to a ninth aspect is the shoe according to any one of the first to seventh aspects, in which the hole is open toward the foot of the wearer.

REFERENCE SIGNS LIST

1 SHOE
2 UPPER
3 SOLE
20 UPPER MAIN BODY
20*a* FOOT INSERTION OPENING
20*b* THROAT PORTION
20*c* LACE HOLE PORTION
20*d* HOLE
20*e* BOTTOM PORTION
20*f* PERIPHERAL PORTION
20*g* BASE PORTION
21 SHOE TONGUE
22 SHOELACE
23 LINEAR MEMBER
30 OUTSOLE
30*a* GROUND CONTACT FACE
31 MIDSOLE
C SHOE CENTER AXIS
R1 UPPER FORE FOOT POSITION
R2 UPPER MIDDLE FOOT POSITION
R3 UPPER REAR FOOT POSITION
S1 FIRST BOUNDARY LINE
S2 SECOND BOUNDARY LINE

The invention claimed is:

1. A shoe comprising an upper that covers an instep of a foot, wherein a hole that has a bottom and is recessed in a thickness direction of the upper is formed integrally in the upper, and a bottom portion of the hole is a single layer including at least two linear members, wherein a difference in Young's modulus between the materials of the two linear members is 5 percent or larger, and wherein the upper includes a peripheral portion having two layers disposed around the bottom portion, part of the linear members being one of the two layers, the remaining part of the linear members being the other one of the two layers.

2. The shoe according to claim 1, wherein a melting point of the material of each of the linear members is 150° C. or higher, and a difference in melting point between the materials of the respective linear members is 30° C. or less.

3. The shoe according to claim 1, wherein the upper includes an upper fore foot position covering a fore foot position of the foot of a wearer, an upper middle foot position covering a middle foot position of the foot of the wearer, and an upper rear foot position covering a rear foot position of the foot of the wearer, and the hole is disposed in the upper fore foot position.

4. The shoe according to claim 3, wherein the hole disposed in a lateral foot side portion of the upper fore foot position is an elongate hole extending in a longitudinal direction.

5. The shoe according to claim 1, wherein the hole is open toward a side opposite to the foot of a wearer.

6. The shoe according to claim 1, wherein the hole is open toward the foot of a wearer.

7. A shoe comprising an upper that covers an instep of a foot, wherein a hole that has a bottom and is recessed in a thickness direction of the upper is formed integrally in the upper, and a bottom portion of the hole is a single layer including at least two linear members, wherein a difference in Young's modulus between the materials of the two linear members is 5 percent or larger, wherein each of the linear members has portions alternately protruding in one direction and the other direction in the thickness direction, and the upper includes: the bottom portion in which the linear members overlap each other in the thickness direction, to form one layer;

a peripheral portion that is disposed around the bottom portion, and has two layers, part of the linear members being one of the two layers, the remaining part of the linear members being the other one of the two layers; and a base portion including: a two-layer portion in which part of the linear members is one layer, and the remaining part of the linear members is the other layer; and a portion in which the linear members intersect with each other.

8. The shoe according to claim 7, wherein a ratio of a thickness of the bottom portion to a thickness of the peripheral portion is 5% to 65%.

9. The shoe according to claim 7, wherein air permeability of a portion of the upper in which the hole is disposed is higher than air permeability of a portion of the upper in which the base portion is disposed.

* * * * *